US008622530B2

(12) United States Patent
Takada et al.

(10) Patent No.: US 8,622,530 B2
(45) Date of Patent: Jan. 7, 2014

(54) INK TANK AND RECORDING APPARATUS

(75) Inventors: Hitoshi Takada, Yokohama (JP); Yasuo Kotaki, Yokohama (JP); Hideki Ogura, Yokohama (JP); Eiichi Adachi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 740 days.

(21) Appl. No.: 12/640,176

(22) Filed: Dec. 17, 2009

(65) Prior Publication Data

US 2010/0157002 A1 Jun. 24, 2010

(30) Foreign Application Priority Data

Dec. 19, 2008 (JP) ..... 2008-324173

(51) Int. Cl.
*B41J 2/175* (2006.01)
*B41J 2/17* (2006.01)
*B41J 2/18* (2006.01)

(52) U.S. Cl.
USPC ..... 347/85; 347/84; 347/86; 347/89

(58) Field of Classification Search
USPC ..... 347/84, 85, 86, 89
See application file for complete search history.

(56) References Cited

U.S. PATENT DOCUMENTS

| | | | | |
|---|---|---|---|---|
| 5,798,781 | A | 8/1998 | Pedersen | |
| 2004/0100540 | A1 | 5/2004 | Hatasa | |
| 2007/0008372 | A1 * | 1/2007 | Katada | 347/36 |
| 2007/0279461 | A1 | 12/2007 | Hiratuka | |

FOREIGN PATENT DOCUMENTS

| | | | | |
|---|---|---|---|---|
| JP | 10-181043 | A | | 7/1998 |
| JP | 10181043 | A | * | 7/1998 |
| JP | 2008-055646 | A | | 3/2008 |
| JP | 2008-273027 | A | | 11/2008 |
| JP | 2008-273043 | A | | 11/2008 |
| WO | 02/096654 | A1 | | 12/2002 |

* cited by examiner

*Primary Examiner* — Jannelle M Lebron
(74) *Attorney, Agent, or Firm* — Canon USA Inc IP Division

(57) ABSTRACT

An ink tank includes an ink supply connection port connected to a main body of a recording apparatus for supplying ink thereto, a first ink reservoir reserving the ink supplied to a sub-tank, a first ink delivery passage supplying the ink reserved in the first ink reservoir to the ink supply connection port, a one-way valve disposed in the first ink delivery passage that enables the ink to move from the first ink reservoir to the ink supply connection port, a second ink reservoir reserving the ink returned from the sub-tank, and a second ink delivery passage supplying the ink reserved in the second ink reservoir to the ink supply connection port and joins with the first ink delivery passage at a position between the one-way valve and the ink supply connection port.

12 Claims, 7 Drawing Sheets

INK TANK AND RECORDING APPARATUS

BACKGROUND OF THE INVENTION

1. Field of the Invention

The present invention relates to an ink tank and a recording apparatus.

2. Description of the Related Art

In an ink jet recording apparatus (hereinafter also referred to simply as a "recording apparatus"), a desired recording operation is performed by ejecting ink droplets to fly out from fine ejection orifices, which are formed in an ink jet recording head (hereinafter also referred to simply as a "recording head"), such that the ink droplets impact a recording medium. In an recording apparatus for recording prints which are put up outdoors, a pigment ink is used for the recording because prints recorded using a dye ink have poor resistance to light and weather.

Pigment ink is prepared by dispersing pigment particles in a solvent. Therefore, when the ink is held in the same posture and state for a long time, the pigment particles tend to precipitate under the influence of gravity. Precipitation of the pigment particles in the pigment ink causes a density gradient in the direction of gravity such that the density of the pigment particles is relatively low in an upper part of the ink and relatively high in a lower part of the ink, as viewed in the direction of gravity. Because shades of the pigment ink depend on the density of the pigment particles, a part of the ink containing the pigment particles at a higher density provides a relatively dark (deep) color and a part of the ink containing the pigment particles at a lower density provides a relatively light (pale) color. Accordingly, a visually recognizable difference in shades occurs in comparison between a print recorded by using the pigment ink in the state where the pigment particles are precipitated and a print recorded by using the pigment ink in the state where the pigment particles are not precipitated and the pigment density is uniform. When a print is recorded using the pigment ink in the state where the pigment particles are precipitated, there is a possibility that color balance differs between a beginning portion and an ending portion in one page of print. To overcome the above-mentioned problems, a proposal for avoiding the precipitation of pigment particles has been made in which an ink is stirred by providing an ink stirring member within an ink tank.

FIG. 7 illustrates an on-carriage ink tank disclosed in Japanese Patent Laid-Open No. 2008-273043. FIG. 7 is a vertical sectional view of the disclosed on-carriage ink tank in a posture that an ink reservoir is mounted to an ink jet recording apparatus. Two swingable members 100 and 110 are disposed within the ink reservoir. Ink flows are generated, as indicated by arrows TA, inside the ink tank with those swingable members 100 and 110 swinging in response to movements of a carriage onto which the ink tank is mounted. The swingable member 100 generates a rising ink flow, and the swingable member 110 generates an ink flow advancing toward the swingable member 100 along a bottom surface of the ink reservoir. With such an arrangement, the ink residing near the bottom surface of the ink reservoir and containing the pigment component at a higher density is raised upwards from the bottom surface. As a result, the ink within the ink reservoir can be efficiently stirred.

In a large-sized ink jet recording apparatus recently commercialized, an off-carriage ink tank having a large capacity of an ink reservoir is used to reduce the replacement frequency of the ink tank. To allow replacement of the ink tank even during recording, this type of ink jet recording apparatus is constructed such that a sub-tank capable of temporarily reserving ink is disposed inside the recording apparatus and the ink is supplied from the sub-tank to a recording head through an ink supply passage formed of a tube. In the ink jet recording apparatus thus constructed, pigment particles precipitate in the pigment ink reserved in the ink supply passage and the sub-tank as well. To cope with the precipitation of the pigment particles, the ink in the ink supply passage and the sub-tank is circulated to stir the ink, to thereby prevent the pigment particles from precipitating in the ink.

FIG. 8 illustrates an ink jet recording apparatus disclosed in Japanese Patent Laid-Open No. 2008-55646. The ink jet recording apparatus illustrated in FIG. 8 includes a sub-tank 2, and a first ink supply passage 8 for circulating ink while bypassing an ink jet head. In the ink jet recording apparatus disclosed in Japanese Patent Laid-Open No. 2008-55646, a circulation pump 9 disposed in the first ink supply passage 8 is operated to suck up the ink within the sub-tank 2 and to convey the ink along circulation routes in sequence, as indicated by arrows a, b, c and d in FIG. 8. Thus, in the ink jet recording apparatus disclosed in Japanese Patent Laid-Open No. 2008-55646, the ink in the first ink supply passage 8 and the ink in the sub-tank 2 can be stirred by returning a large volume of the ink to the sub-tank 2 at a high speed. As a result, pigment particles can be prevented from precipitating in the ink. Further, a magnet stirrer 15 is disposed within the sub-tank 2 to stir the ink in the sub-tank 2, thereby further preventing precipitation of the pigment particles in the ink.

However, the construction disclosed in Japanese Patent Laid-Open No. 2008-273043 is limited in its application to the ink jet recording apparatus employing the on-carriage ink tank, and it cannot be applied to the case of stirring the ink reserved in the sub-tank which is fixedly mounted to a main body of the recording apparatus.

Also, the construction disclosed in Japanese Patent Laid-Open No. 2008-55646 requires a passage for stirring the ink to be provided separately from an ink supply path for the recording operation. In other words, the passage arrangement is complicated, which increases the size and cost of the apparatus.

SUMMARY OF THE INVENTION

In relation to a recording apparatus of the type reserving a pigment ink in an ink tank fixed to a main body of the recording apparatus and supplying the pigment ink from the ink tank to a recording head, an exemplary embodiment of the present invention provides the ink tank and the recording apparatus which can hold uniform density of the pigment ink reserved in the ink tank fixed to the main body of the recording apparatus and which can record an image with high quality.

According to an exemplary embodiment of the present invention, in an ink tank capable of being mounted to a recording apparatus includes a recording head configured to eject ink and a sub-tank configured to reserve the ink supplied to the recording head, wherein the ink tank includes an ink supply connection port connected to a main body of the recording apparatus for supply of the ink to the main body when the ink tank is mounted to the recording apparatus, a first ink reservoir configured to reserve the ink supplied to the sub-tank, a first ink delivery passage configured to supply the ink reserved in the first ink reservoir to the ink supply connection port, a one-way valve disposed in the first ink delivery passage, wherein the one-way valve enables the ink to move from the first ink reservoir to the ink supply connection port, a second ink reservoir configured to reserve the ink returned from the sub-tank, and a second ink delivery passage configured to supply the ink reserved in the second ink reservoir to the ink supply connection port, wherein the second ink delivery passage joins with the first ink delivery passage at a position between the one-way valve and the ink supply connection port.

Further features of the present invention will become apparent from the following description of exemplary embodiments with reference to the attached drawings.

DESCRIPTION OF THE EMBODIMENTS

Figure 1:
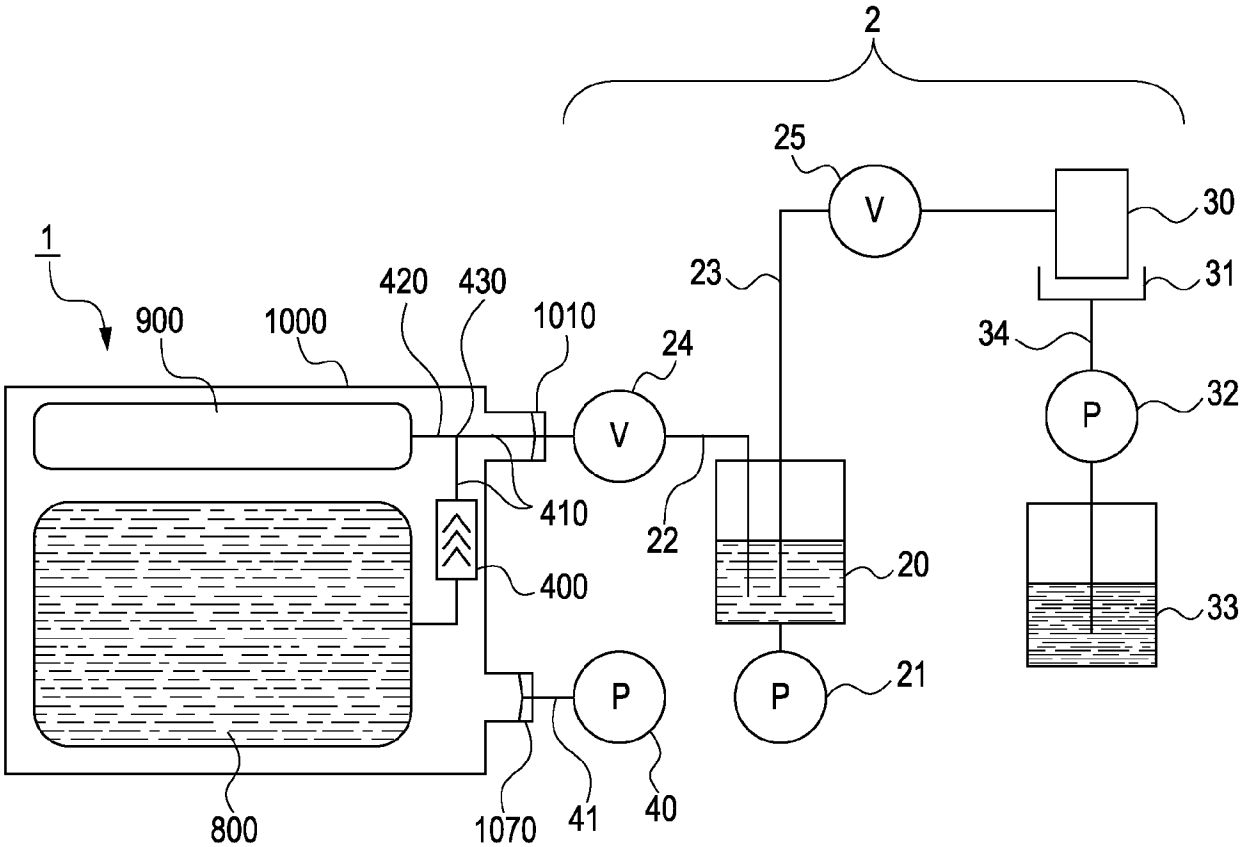
FIG. 1 is a schematic view of a recording apparatus using an ink tank according to an exemplary embodiment of the present invention.

FIG. 1 is a schematic view of a recording apparatus using an ink tank according to an exemplary embodiment of the present invention. In FIG. 1, reference numeral 1 denotes an ink tank, and reference numeral 2 denotes a main body of the recording apparatus. The ink tank 1 is detachably mounted to the main body 2.

The ink tank 1 includes an ink supply connection port 1010 and a pressure supply connection port 1070 which are connected to the main body 2 of the recording apparatus when the ink tank 1 is mounted to the main body 2, and a tank case 1000 serving as a housing (enclosure). Inside the tank case 1000, there is provided a first ink reservoir 800, a second ink reservoir 900, a first ink delivery passage 410, a second ink delivery passage 420, a branch point 430, and a one-way valve 400.

The first ink reservoir 800 and the ink supply connection port 1010 are connected to each other by the first ink delivery passage 410. The branch point 430, which is located in the first ink delivery passage 410, and the second ink reservoir 900 are connected to each other by the second ink delivery passage 420. The one-way valve 400 is disposed in the first ink delivery passage 410 at a position between the first ink reservoir 800 and the branch point 430. The one-way valve 400 allows ink to flow in a direction from the first ink reservoir 800 toward the branch point 430, but it does not allow ink to flow in a direction from the branch point 430 toward the first ink reservoir 800.

In FIG. 1, reference numeral 30 denotes a recording head. Reference numeral 20 denotes a sub-tank for storing the ink supplied to the recording head 30. The ink is supplied from the ink tank 1 to the sub-tank 20. The ink supply connection port 1010 of the ink tank 1 and the sub-tank 20 are connected to each other by a first ink supply passage 22. Further, the sub-tank 20 and the recording head 30 are connected to each other by a second ink supply passage 23. A first valve 24, serving as a first opening and closing mechanism, is disposed in the first ink supply passage 22, and a second valve 25, serving as a second opening and closing mechanism, is disposed in the second ink supply passage 23.

Reference numeral 31 denotes a cap capable of contacting with and departing away from a discharge orifice surface of the recording head 30. Reference numeral 33 is a waste ink tank into which the ink discharged from the recording head 30 is recovered. The cap 31 and the waste ink tank 33 are connected to each other by a waste ink recovery passage 34. A suction pump 32 is disposed in the waste ink recovery passage 34.

Reference numeral 40 denotes a pressurizing pump. Reference numeral 41 denotes a pressure supply passage connecting the pressurizing pump 40 to the pressure supply connection port 1070 of the ink tank 1.

The construction for supplying the ink from the first ink reservoir 800 within the ink tank 1 to the recording head 30 will be described below. The interior of the tank case 1000 is pressurized by operating the pressurizing pump 40 which is connected to the pressure supply connection port 1070. The first ink reservoir 800 is in the form of a bag made of a flexible material. Therefore, when the interior of the tank case 1000 is pressurized, the first ink reservoir 800 is collapsed and the ink is supplied from the first ink reservoir 800.

The ink is supplied from the first ink reservoir 800 within the ink tank 1 to the apparatus main body 2 through the first ink delivery passage 410 and the ink supply connection port 1010. Because the ink supply connection port 1010 of the ink tank 1 is connected to the first ink supply passage 22, the ink supplied from the first ink reservoir 800 is temporarily reserved in the sub-tank 20. The ink is supplied to the sub-tank 20 by opening the first valve 24 disposed in the first ink supply passage 22. Because the ink can be temporarily reserved in the sub-tank 20 within the apparatus main body 2, the ink tank 1 can be replaced while the recording operation is continued by using the recording head 30.

When the ink is supplied from the sub-tank 20 to the recording head 30, the first valve 24 is closed and the second valve 25 is opened. Thereafter, the interior of the sub-tank 20 is pressurized by using a pressuring and depressurizing pump 21 which is used as a pressure adjusting mechanism for adjusting the pressure within the sub-tank 20. With such pressurization, the ink temporarily reserved in the sub-tank 20 is supplied to the recording head 30 through the second ink supply passage 23. The ink that is not used in the recording and is discharged from the recording head (hereinafter referred to as "waste ink") is recovered by the cap 31 disposed opposite to the recording head 30. The waste ink is then sucked by the suction pump 32 and reserved in the waste ink tank 33 through the waste ink recovery passage 34.

As suggested above, the first ink reservoir 800 and the second ink reservoir 900 are each in the form of a bag made of a flexible material. Accordingly, when the interior of the ink tank 1 is pressurized, the first ink reservoir 800 is contracted and the ink within the first ink reservoir 800 is supplied. Further, the ink reserved in the first ink reservoir 800 can be all used up. The second ink reservoir 900 can be constituted in such a small size that it is disposed inside the ink tank 1 without occupying an extra space during the distribution stage of the recording apparatus. In addition, the second ink reservoir 900 can be repeatedly expanded and contracted corresponding to a stirring operation (described later), whereby efficient stirring is ensured. A highly pliable polyethylene is preferably used as the flexible material. For example, the flexible material can be of a structure that a polyethylene film is sandwiched between a nylon film on the outer side and a polypropylene film on the inner side. Another selectable example is an aluminum laminated film including a layer of an aluminum foil to suppress evaporation of the ink.

The ink reserving capacity of the second ink reservoir 900 can be set equal to or smaller than the volume of the sub-tank 20. The reason is that, if the ink in the sub-tank 20 can be powerfully sent to the second ink reservoir 900, precipitation of pigment particles in the ink can be suppressed without returning all of the ink in amount corresponding to the volume of the sub-tank 20 for the purpose of stirring.

Figure 2:
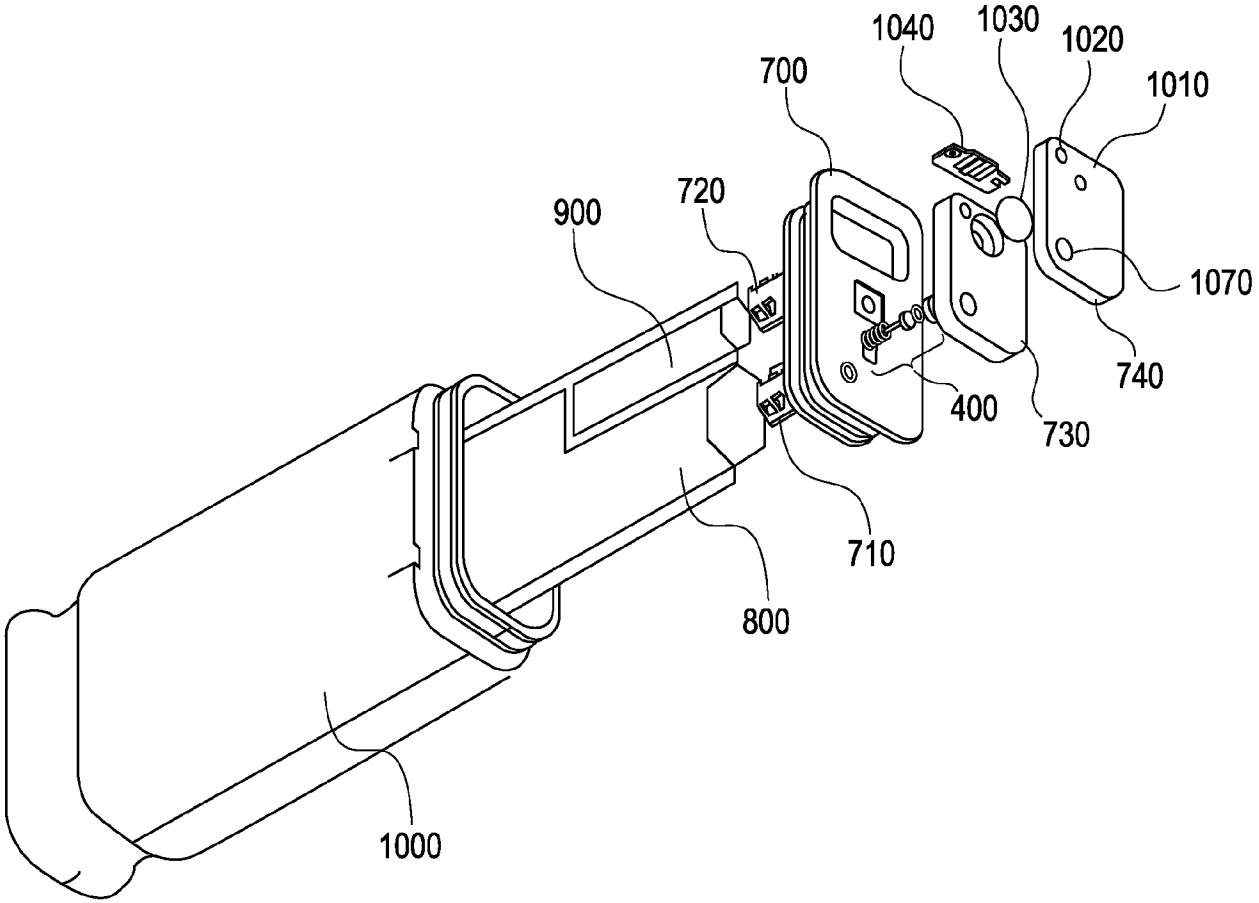
FIG. 2 is an exploded perspective view of the ink tank according to the exemplary embodiment of the present invention.

FIG. 2 is an exploded perspective view of the ink tank according to the exemplary embodiment of the present invention. The first ink reservoir 800 and the second ink reservoir 900 are constituted by forming one flexible film into two bags. A first member 700 is provided with a first boat-shaped portion 710 and a second boat-shaped portion 720. An enclosable ink reservoir can be formed by fusion-welding the first ink reservoir 800 to the first boat-shaped portion 710 and the second ink reservoir 900 to the second boat-shaped portion 720, respectively. The interior of the tank case 1000 may be partitioned to form the first ink reservoir 800 and the second ink reservoir 900 separately from each other such that the second ink reservoir 900 is not affected by the pressure developed when the ink is supplied from the first ink reservoir 800 under pressurization. The first ink delivery passage 410, the second ink delivery passage 420, and the branch point 430 are formed by pressure-bonding a second member 730 and a third member 740 together, in each or either of which one or more grooves are formed. A storage medium 1040, e.g., a semiconductor memory, may be disposed within the ink tank 1 such that, for example, an amount of reserved ink is memorized in the storage medium 1040 to confirm an ink amount in the first ink reservoir 800 and to notify a time at which the ink tank 1 is to be replaced. A rubber valve 1030 is fitted to the ink supply connection port 1010 so as to prevent the ink from leaking when the ink tank 1 is attached and detached. Moreover, the ink tank 1 is properly positioned relative to the apparatus main body 2 by using two axes which are defined by the pressure supply connection port 1070, which can also serves as a positioning engagement portion, and a positioning engagement portion 1020. Hence the ink tank 1 can be easily positioned in three-dimensional directions.

(Ink Stirring Operation)

Figure 3:
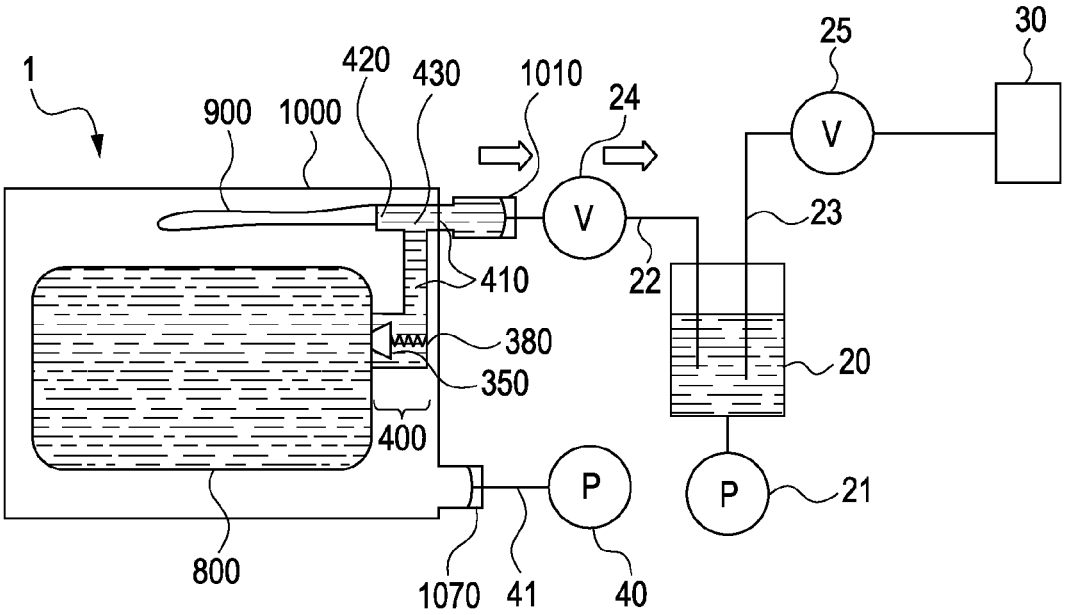
FIG. 3 is an explanatory view illustrating an operation of supplying ink to a sub-tank from the ink tank in accordance with the exemplary embodiment of the present invention.
Figure 4:
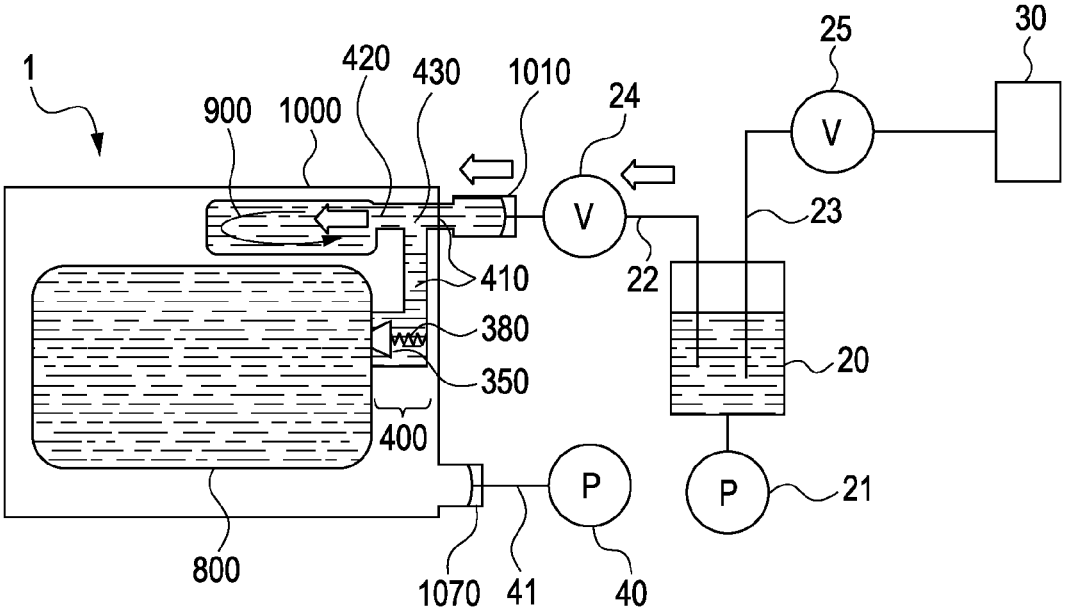
FIG. 4 is an explanatory view illustrating an operation of stirring the ink in accordance with the exemplary embodiment of the present invention.
Figure 5:
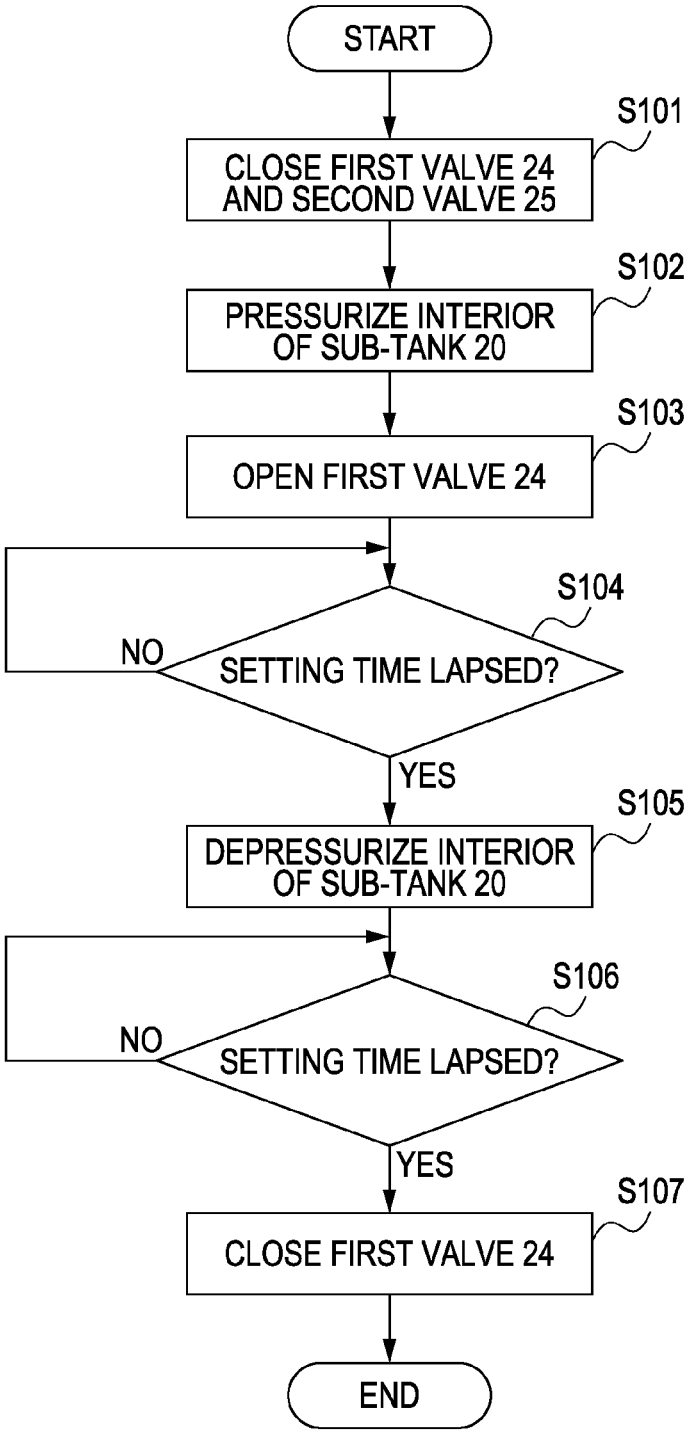
FIG. 5 is a flowchart illustrating the operation of stirring the ink in accordance with the exemplary embodiment of the present invention.

When the ink reserved in the first ink supply passage 22 and the sub-tank 20 is left in the same state for a long time, the pigment particles in the ink precipitate. An ink stirring operation is performed to prevent the precipitation of the pigment particles. The ink stirring operation performed in an ink jet recording system according to the exemplary embodiment will be described below with reference to FIGS. 3 to 5. FIG. 3 is an explanatory view illustrating an operation of supplying ink to the sub-tank from the ink tank in accordance with the exemplary embodiment of the present invention. FIG. 4 is an explanatory view illustrating an operation of stirring the ink in accordance with the exemplary embodiment of the present invention. FIG. 5 is a flowchart illustrating the operation of stirring the ink in accordance with the exemplary embodiment of the present invention.

As illustrated in FIG. 3, after the ink tank 1 is mounted to the apparatus main body 2, the interior of the ink tank 1 is pressurized by the pressurizing pump 40 and the ink is supplied from the first ink reservoir 800 to the sub-tank 20. Upon completion of the ink supply to the sub-tank 20, the first valve 24 and the second valve 24 are closed in S101 of FIG. 5. The interior of the sub-tank 20 is pressurized by the pressuring and depressurizing pump 21 in S102. The step of pressurizing the interior of the sub-tank 20 by the pressuring and depressurizing pump 21 is called a first step. In this state, the interior of the tank case 1000 is open to the atmosphere and no pressure is applied to the first ink reservoir 800 and the second ink reservoir 900. Accordingly, the pressure inside the first ink reservoir 800 and the second ink reservoir 900 is held at the atmospheric pressure, while only the interior of the sub-tank 20 is pressurized by the pressuring and depressurizing pump 21.

As illustrated in FIG. 4, when the first valve 24 is opened as a second step in S103, the ink within the sub-tank 20 is sent to the ink supply connection port 1010 of the ink tank 1 through the first ink supply passage 22. The ink sent to the ink tank 1 is further sent from the ink supply connection port 1010 to the second ink reservoir 900 through the first ink delivery passage 410 and the second ink delivery passage 420. At that time, due to the presence of a pressure difference between the interior of the second ink reservoir 900 and the interior of the sub-tank 20, the ink in the sub-tank 20 is caused to powerfully flow into the second ink reservoir 900. Therefore, an ink flow is generated as indicated by an arrow in FIG. 4 so that the precipitated pigment component is raised and the ink is stirred. With the provision of the one-way valve 400 in the first ink delivery passage 410, the ink is prevented from flowing backwards into the first ink reservoir 800 even when the ink is powerfully returned from the sub-tank 20 to the second ink reservoir 900. The one-way valve 400 disposed within the ink tank 1 in this exemplary embodiment is constituted by a valve member 350 and a compressed spring 380. Stated another way, when the ink is sent from the sub-tank 20 to the second ink reservoir 900, the ink is prevented from entering the first ink reservoir 800 because the valve member 350 is held in place by the compressed spring 380. The ink flow directing from the sub-tank 20 to the second ink reservoir 900 loses its power due to the viscous resistance of the ink, for example, after the lapse of a certain time. A time taken until the power of the ink flow is lost is set in advance.

After the lapse of a standby time set in S104, the interior of the sub-tank 20 is depressurized as a third step in S105 by the pressuring and depressurizing pump 21. Herein, the flow resistance of the second ink delivery passage 420 is set to be smaller than the sum of (flow resistance of a portion of the first ink delivery passage 410 between the first ink reservoir 800 and the branch point 430)+(valve opening pressure of the one-way valve 400). Therefore, the ink having been sent to the second ink reservoir 900 is supplied to the sub-tank 20 at an earlier timing than the ink reserved in the first ink reservoir 800. After it is confirmed in S106 that a setting time enough for the ink to be sent from the second ink reservoir 900 to the sub-tank 20 has lapsed, the first valve 24 is closed in S107. The ink stirring operation is then brought to an end.

Figure 6:
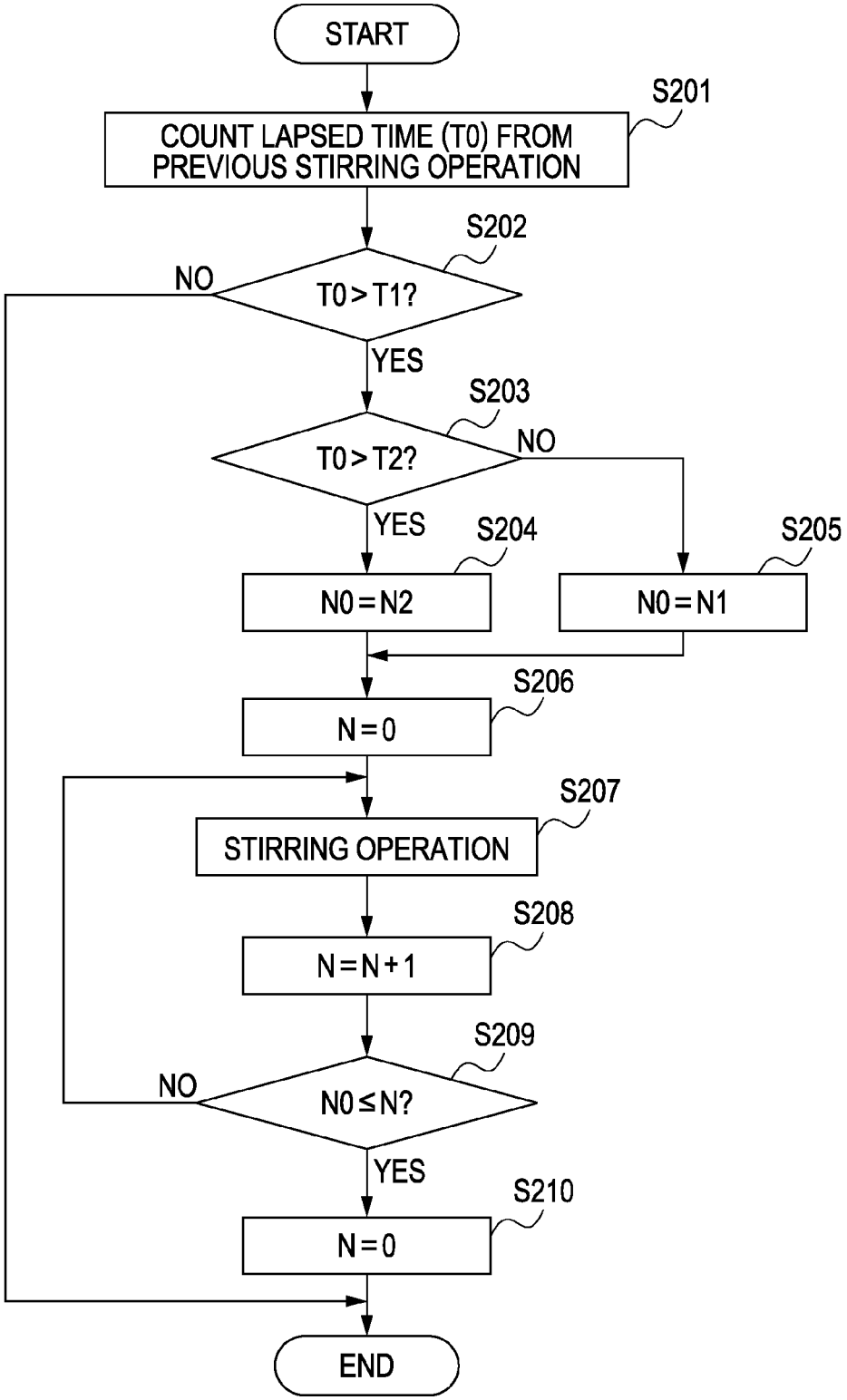
FIG. 6 is a flowchart for determining a count of stirring in accordance with the exemplary embodiment of the present invention.
Figure 7:
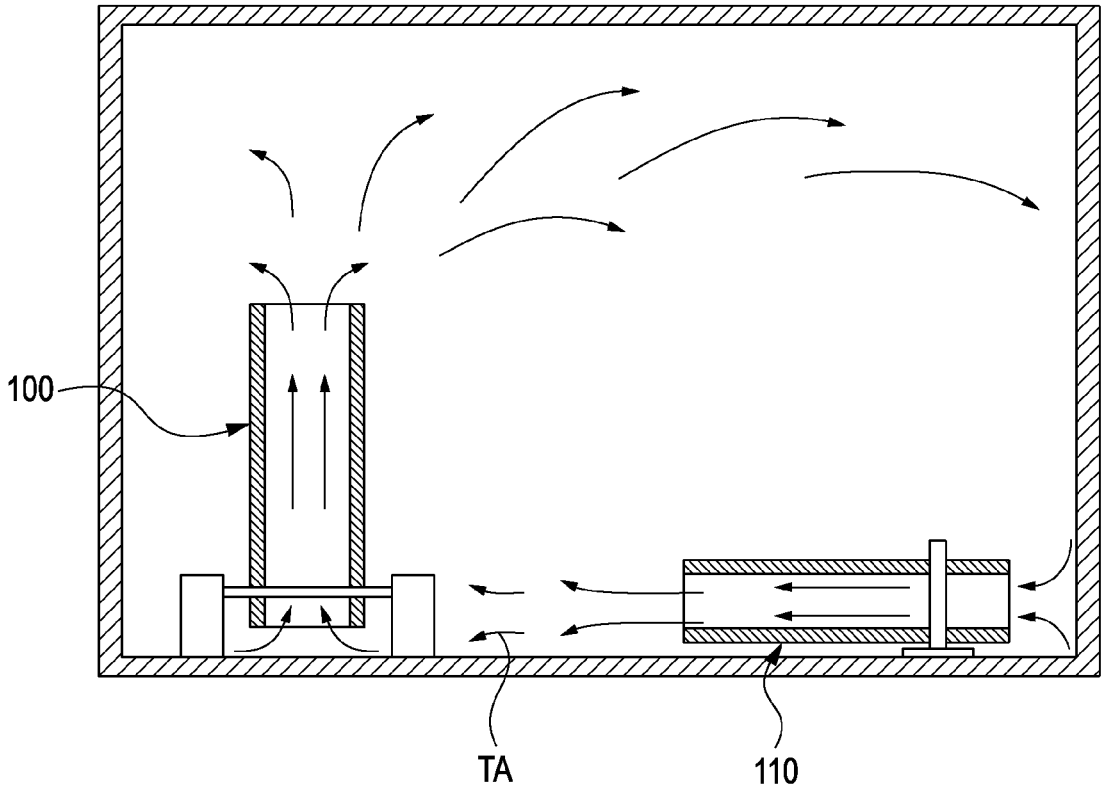
FIG. 7 PRIOR ART
FIG. 7 illustrates one related art.
Figure 8:
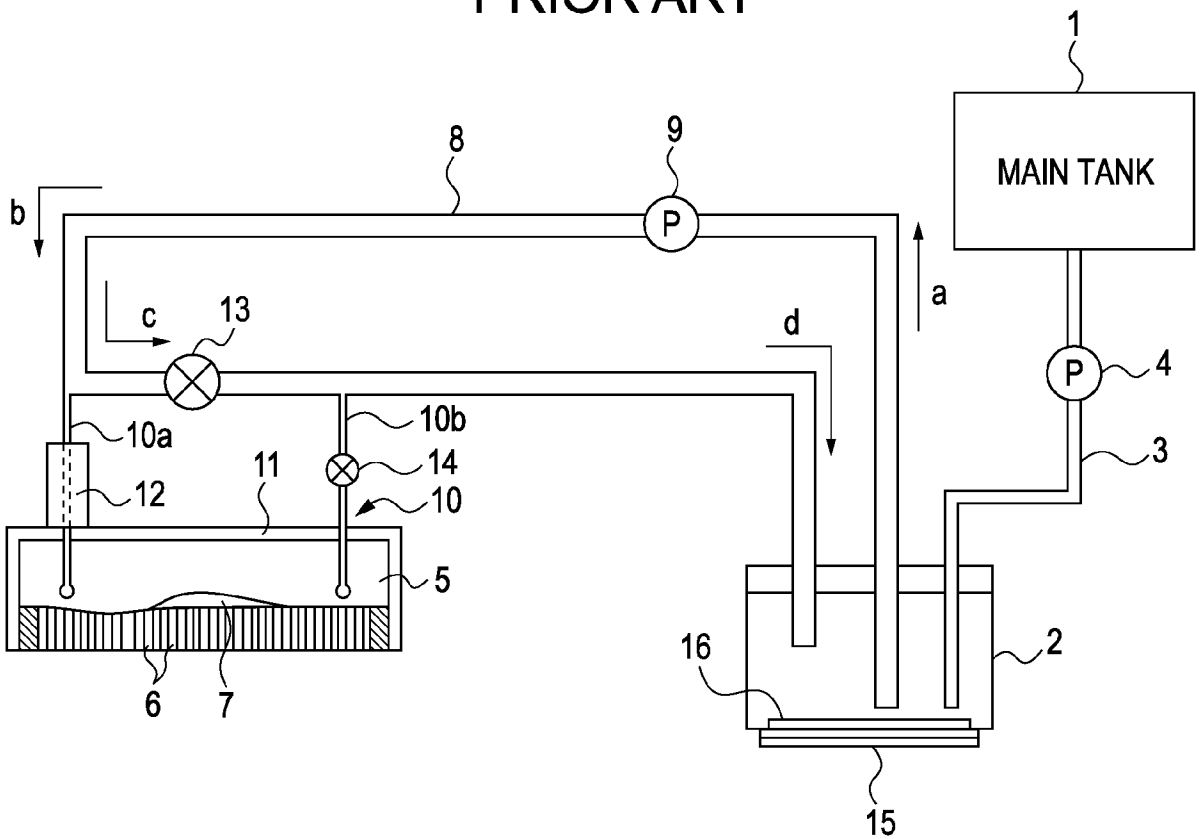
FIG. 8 PRIOR ART
FIG. 8 illustrates another related art.

By performing the ink stirring operation in accordance with the flowchart of FIG. 5 as described above, it is possible to prevent degradation of image quality, which would be otherwise caused by precipitation of the pigment particles in the ink. However, when the stirring operation is not performed for a long time, there is a possibility that the pigment particles in the ink are not sufficiently stirred by one cycle of stirring operation. In this exemplary embodiment, therefore the stirring operation is controlled to be repeated plural times depending on a time lapsed from the previous cycle of stirring operation. FIG. 6 is a flowchart for determining a count of stirring (i.e., the number of times of ink stirring) in accordance with the exemplary embodiment of the present invention.

In the flowchart of FIG. 6, it is assumed that the time lapsed from the previous cycle of stirring operation is T0, a predetermined lapsed time representing a threshold at which the stirring operation is estimated to be required is T1, and a predetermined lapsed time representing a threshold at which plural cycles of stirring operation are estimated to be required because the time lapsed from the previous cycle of stirring operation is long is T2. Referring to FIG. 6, the time T0 lapsed from the previous cycle of stirring operation is counted in S201 by a timer (not shown), and the predetermined lapsed time T1, which represents the necessity of the stirring operation, is compared with T0 in step S202. If T0 is shorter (smaller) than T1, the processing of FIG. 6 is brought to an end without performing the stirring operation. If T0 is longer (larger) than T1, the processing advances to S203. In S203, T2 is compared with T0. If T0 is shorter (smaller) than T2, the processing advances to S204. If T0 is longer (larger) than T2, the processing advances to S205. In each of S204 and S205, a count N0 of stirring can be set to a number which is required to resolve the precipitation of the pigment particles depending on the corresponding lapsed time. Specifically, N0=N2 is set in S204 and N0=N1 is set in S205. N1 and N2 are determined based on the characteristics of the ink, the amount of ink reserved in the sub-tank, and so on.

In S206, N=0 is input as the count of stirring. The stirring operation is performed in S207, and N=N+1 is input in S208. In is determined in S209 whether N reaches N0. If N does not reach N0, the processing returns to S207 to perform the stirring operation. If N reaches N0, the processing advances to S210 for resetting to N=0. The stirring operation is then brought to an end.

With the exemplary embodiment of the present invention, as described above, the ink stirring operation can be performed by operating the pressuring and depressurizing pump 21, which is associated with the sub-tank 20, such that the ink is moved to powerfully reciprocate between the second ink reservoir 900 disposed within the ink tank 1 and the sub-tank 20. As a result, the ink can be stirred without providing a passage which does not take part in the recording operation. Further, image quality can be prevented from degrading with the pigment particles precipitating in the ink, and the recording operation with higher reliability can be realized.

(In Distribution Stage of Ink Tank)

When the ink tank is distributed through the market, the first ink reservoir 800 is filled with the ink. In such a state, it is advantageous that the second ink reservoir 900 is employed to serve as a buffer for the first ink reservoir 800. More specifically, in the event that the ink within the first ink reservoir 800 overflows with volume expansion of the ink or air inside the first ink reservoir 800, which may be caused due to changes in temperature and/or atmospheric pressure, the overflowed ink can be reserved in the second ink reservoir 900. For that reason, the second ink reservoir 900 should not be fully filled with the ink when the ink tank is distributed. Stated another way, the ink tank having higher reliability can be provided by providing the second ink reservoir 900 within the ink tank and by utilizing the second ink reservoir 900 as a buffer when the ink tank is distributed.

According to the exemplary embodiment of the present invention, the ink stirring operation can be performed by causing the ink to be powerfully sent from the sub-tank to the second ink reservoir disposed within the ink tank by using the pressure adjusting mechanism, and the ink can be stirred without providing a passage which does not take part in the ink jet recording operation. It is hence possible to provide the ink tank and the recording apparatus, which can prevent image quality from degrading with the pigment particles precipitating in the ink, and which can perform the recording operation with higher reliability.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-324173 filed Dec. 19, 2008, which is hereby incorporated by reference herein in its entirety.

What is claimed is:

1. An ink tank mounted to a recording apparatus including a recording head configured to eject ink and a sub-tank arranged to reserve the ink supplied to the recording head, the ink tank comprising:

an ink supply connection port connected to a main body of the recording apparatus configured to supply ink to the main body when the ink tank is mounted to the recording apparatus;

a first ink reservoir configured to reserve the ink supplied to the sub-tank;

a first ink delivery passage configured to supply the ink reserved in the first ink reservoir to the ink supply connection port;

a one-way valve disposed in the first ink delivery passage, wherein the one-way valve enables the ink to move from the first ink reservoir to the ink supply connection port;

a second ink reservoir configured to reserve the ink returned from the sub-tank; and a second ink delivery passage configured to supply the ink reserved in the second ink reservoir to the ink supply connection port, wherein the second ink delivery passage joins with the first ink delivery passage at a position between the one-way valve and the ink supply connection port, and wherein the one-way valve forces ink flow from the sub-tank to the second ink reservoir via the second ink delivery passage.

2. The ink tank according to claim 1, wherein the first ink reservoir is made of a flexible material.

3. The ink tank according to claim 1, wherein the second ink reservoir is made of a flexible material.

4. The ink tank according to claim 1, further including a pressure supply connection port, wherein the pressure supply connection port is connected to a pressurizing pump, and wherein the ink reserved in the first ink reservoir is supplied to the main body of the recording apparatus when the pressurizing pump pressurizes the ink tank through the pressure supply connection port.

5. The ink tank according to claim 1, wherein flow resistance of the second ink delivery passage is less than the sum of flow resistance of a portion of the first ink delivery passage from the first ink reservoir to the position at which the second ink delivery passage joins with the first ink delivery passage and flow resistance of the one-way valve.

6. A recording apparatus including:

a recording head configured to eject ink;

a sub-tank configured to reserve ink supplied to the recording head; and an ink tank mounted to the recording apparatus, wherein the ink tank includes an ink supply connection port connected to a main body of the recording apparatus for supplying ink to the main body when the ink tank is mounted to the recording apparatus, a first ink reservoir arranged to reserve the ink supplied to the sub-tank, a first ink delivery passage arranged to supply the ink reserved in the first ink reservoir to the ink supply connection port, a one-way valve disposed in the first ink delivery passage, wherein the one-way valve enables the ink to move from the first ink reservoir to the ink supply connection port, a second ink reservoir capable of reserving the ink returned from the sub-tank and a second ink delivery passage configured to supply the ink reserved in the second ink reservoir to the ink supply connection port, wherein the second ink delivery passage joins with the first ink delivery passage at a position between the one-way valve and the ink supply connection port, and wherein the one-way valve forces ink flow from the sub-tank to the second ink reservoir via the second ink delivery passage.

7. The recording apparatus according to claim 6, wherein the first ink reservoir is made of a flexible material.

8. The recording apparatus according to claim 6, wherein the second ink reservoir is made of a flexible material.

9. The recording apparatus according to claim 6, further including a pressure supply connection port, wherein the pressure supply connection port is connected to a pressurizing pump, and wherein the ink reserved in the first ink reservoir is supplied to the main body of the recording apparatus when the ink tank is pressurized by the pressurizing pump through the pressure supply connection port.

10. The recording apparatus according to claim 6, further including a pressurizing and depressurizing pump to change pressure in the sub-tank, wherein the ink reserved in the sub-tank is returned to the ink tank by pressurizing the sub-tank using the pressurizing and depressurizing pump.

11. The recording apparatus according to claim 10, wherein the ink having been returned to the ink tank is supplied to the sub-tank again by depressurizing the sub-tank using the pressurizing and depressurizing pump.

12. An ink tank mounted to a recording apparatus including a recording head configured to eject ink and a sub-tank arranged to reserve the ink supplied to the recording head, the ink tank comprising:

an ink supply connection port connected to a main body of the recording apparatus configured to supply ink to the main body when the ink tank is mounted to the recording apparatus;

a first ink reservoir configured to reserve the ink supplied to the sub-tank;

a first ink delivery passage configured to supply the ink reserved in the first ink reservoir to the ink supply connection port;

a one-way valve disposed in the first ink delivery passage, wherein the one-way valve enables the ink to move from the first ink reservoir to the ink supply connection port;

a second ink reservoir configured to reserve the ink returned from the sub-tank; and a second ink delivery passage configured to supply the ink reserved in the second ink reservoir to the ink supply connection port, wherein the second ink delivery passage joins with the first ink delivery passage at a position between the one-way valve and the ink supply connection port, wherein flow resistance of the second ink delivery passage is less than the sum of flow resistance of a portion of the first ink delivery passage from the first ink reservoir to the position at which the second ink delivery passage joins with the first ink delivery passage and flow resistance of the one-way valve.

* * * * *